US010801368B2

(12) United States Patent
Sakamoto et al.

(10) Patent No.: US 10,801,368 B2
(45) Date of Patent: Oct. 13, 2020

(54) TURBOCHARGER

(71) Applicant: MITSUBISHI HEAVY INDUSTRIES ENGINE & TURBOCHARGER, LTD., Sagamihara-shi, Kanagawa (JP)

(72) Inventors: Keigo Sakamoto, Tokyo (JP); Eigo Katou, Tokyo (JP); Youji Akiyama, Tokyo (JP); Makoto Ozaki, Tokyo (JP); Daigo Watanabe, Tokyo (JP)

(73) Assignee: MITSUBISHI HEAVY INDUSTRIES ENGINE & TURBOCHARGER, LTD., Sagamihara-Shi (JP)

( * ) Notice: Subject to any disclaimer, the term of this patent is extended or adjusted under 35 U.S.C. 154(b) by 40 days.

(21) Appl. No.: 15/555,251

(22) PCT Filed: Mar. 5, 2015

(86) PCT No.: PCT/JP2015/056518
§ 371 (c)(1),
(2) Date: Sep. 1, 2017

(87) PCT Pub. No.: WO2016/139799
PCT Pub. Date: Sep. 9, 2016

(65) Prior Publication Data

US 2018/0016942 A1 Jan. 18, 2018

(51) Int. Cl.
*F01D 25/26* (2006.01)
*F02B 39/00* (2006.01)
(Continued)

(52) U.S. Cl.
CPC ..... *F01D 25/26* (2013.01); *F01D 5/043* (2013.01); *F01D 9/026* (2013.01); *F01D 11/003* (2013.01);
(Continued)

(58) Field of Classification Search
CPC ..... F01D 25/26; F01D 25/28; F01D 5/043; F01D 11/005; F05D 2220/40
See application file for complete search history.

(56) References Cited

U.S. PATENT DOCUMENTS 4,907,952 A 3/1990 Inoue et al.
5,372,485 A * 12/1994 Sumser ..... F01D 17/14 415/166
(Continued)

FOREIGN PATENT DOCUMENTS

CN 101649756 A 2/2010
DE 10 2006 018 055 A1 10/2007
(Continued)

OTHER PUBLICATIONS

JP2013068153A—English (Year: 2013).*
(Continued)

*Primary Examiner* — Shafiq Mian
(74) *Attorney, Agent, or Firm* — Birch, Stewart, Kolasch & Birch, LLP

(57) ABSTRACT

A turbocharger includes: a turbine wheel; a turbine housing; a bearing housing; a shroud having a facing surface which faces a tip of a blade of the turbine wheel and being configured to surround the turbine wheel, the shroud comprising a separate member from the turbine housing and being disposed inside the turbine housing via a gap with respect to the turbine housing; a mount supported to at least one of the turbine housing or the bearing housing, at a position closer to the bearing housing than a scroll flow path in an axial direction of the turbine wheel; and at least one connection part connecting the mount and the shroud.

13 Claims, 8 Drawing Sheets

(51) Int. Cl.

| | |
|---|---|
| ***F02B 39/14*** | (2006.01) |
| ***F01D 11/00*** | (2006.01) |
| ***F01D 9/02*** | (2006.01) |
| ***F01D 5/04*** | (2006.01) |
| ***F01D 25/28*** | (2006.01) |
| *F02B 37/00* | (2006.01) |

(52) U.S. Cl.

CPC ..... *F01D 11/005* (2013.01); *F01D 25/28* (2013.01); *F02B 39/00* (2013.01); *F02B 39/14* (2013.01); *F02B 37/00* (2013.01); *F05D 2220/40* (2013.01); *F05D 2230/54* (2013.01); *F05D 2240/581* (2013.01)

(56) References Cited

U.S. PATENT DOCUMENTS

| | | | | |
|---|---|---|---|---|
| 5,441,383 | A * | 8/1995 | Dale | F01D 17/143 415/150 |
| 5,758,500 | A * | 6/1998 | Sumser | F01D 17/141 415/158 |
| 6,982,216 | B1 * | 1/2006 | Yamashita | H01L 21/26586 257/E21.345 |
| 7,047,739 | B2 * | 5/2006 | Fledersbacher | F01D 9/026 415/157 |
| 8,628,296 | B2 * | 1/2014 | Grussmann | F01D 25/243 415/204 |
| 2005/0133012 | A1 | 6/2005 | Grussmann et al. | |
| 2006/0133931 | A1 | 6/2006 | Burmester et al. | |
| 2009/0094979 | A1 | 4/2009 | Eissler et al. | |
| 2010/0316490 | A1 * | 12/2010 | Severin | F01D 25/145 415/157 |
| 2011/0167817 | A1 * | 7/2011 | Sausse | F01D 17/165 60/602 |
| 2013/0156567 | A1 | 6/2013 | Nagae et al. | |
| 2013/0259661 | A1 * | 10/2013 | Shudo | F01D 11/003 415/170.1 |
| 2014/0037436 | A1 * | 2/2014 | Tabata | F01D 25/24 415/178 |
| 2014/0119907 | A1 | 5/2014 | Maeda et al. | |
| 2014/0241858 | A1 | 8/2014 | Tashiro et al. | |

FOREIGN PATENT DOCUMENTS

| | | | | |
|---|---|---|---|---|
| EP | 2 325 454 | A1 | 5/2011 | |
| JP | 63-150424 | A | 6/1988 | |
| JP | 2002-4871 | A | 1/2002 | |
| JP | 2005-147139 | A | 6/2005 | |
| JP | 2007-2791 | A | 1/2007 | |
| JP | 2007-309139 | A | 11/2007 | |
| JP | 2010-96110 | A | 4/2010 | |
| JP | 4448064 | B2 * | 4/2010 | |
| JP | 2011-174460 | A | 9/2011 | |
| JP | 2013-68153 | A | 4/2013 | |
| JP | 2013068153 | A * | 4/2013 | F01D 11/005 |
| JP | 2014-66150 | A | 4/2014 | |
| JP | 2015-31237 | A | 2/2015 | |
| WO | WO 2013/005319 | A1 | 1/2013 | |

OTHER PUBLICATIONS

JP 4448064B2 English (Year: 2010).*

International Preliminary Report on Patentability and Written Opinion of the International Searching Authority (Forms PCT/IB/338, PCT/IB/373, PCT/ISA/237 and PCT/IB/326) in International Application No. PCT/JP2015/056518 dated Sep. 14, 2017, together with an English translation.

International Search Report and Written Opinion of the INternational Searching Authority (Forms PCT/ISA/210 and PCT/ISA/237) issued in International Application No. PCT/JP2015/056518 dated Jun. 2, 2015.

Office Action dated Nov. 16, 2018 issued in the corresponding Japanese Application No. 2017-503291 with a machine translation.

Extended European Search Report effective Feb. 20, 2018 issued to the corresponding EP Application No. 15883966.2.

Office Action effective Feb. 11, 2019 issued in the corresponding Chinese Application No. 201580077408.1 with a Machine English Translation.

Office Action dated Jun. 15, 2018, issued to the corresponding Japanese Application No. 2017-503291 with a Machine Translation.

Decision of Refusal dated Feb. 26, 2019 issued in the corresponding Japanese Application No. 2017-503291.

Office Action dated Nov. 1, 2019 in corresponding Chinese Application No. 201580077408.1 with an English Translation.

Japanese Office Action dated May 26, 2020, for counterpart Japanese Application No. 2019-093744, with English translation.

* cited by examiner

TURBOCHARGER

TECHNICAL FIELD

The present disclosure relates a turbocharger.

BACKGROUND ART

A turbocharger is known as a measure for improving the thermal efficiency of an internal combustion engine. Patent Document 1 discloses a turbocharger "including a center core disposed on the center part of a scroll part of the turbocharger, a flow passage outlet section, a bearing engagement portion, and a support column, which are formed integrally from a steel tube member, thereby preventing a change in the tip clearance due to thermal deformation of the scroll part body to reduce the costs and weight, while improving the durability, reliability, and shock resistance of a turbine".

According to Patent Document 1, the center core of the turbocharger is formed of a steel member integrally shaped into an annular shape, which makes it possible to reduce the thickness and to reduce the heat capacity. As a result, the temperature of the turbine part increases faster, which promotes warming of the exhaust gas purifying device at the downstream side, and the purifying effect of the exhaust gas purifying device is efficiently exerted.

CITATION LIST

Patent Literature

Patent Document 1: JP2011-1744460A

SUMMARY

Problems to be Solved

Meanwhile, according to findings of the present inventors, during operation of the turbocharger, the turbine housing forming the scroll flow path is subject to bending deformation (thermal deformation) due to the temperature variation inside the turbine housing. In particular, if the part forming the scroll flow path in the turbine housing is made of sheet metal, considerable bending deformation is likely to occur.

For instance, as shown in FIGS. 7 to 9, in a case where the turbine housing 004 is a double-layer structure housing including the first housing 030 made of sheet metal and the second housing 032 made of sheet metal, the first housing 030 forming the scroll flow path 014 has a temperature distribution as shown in FIG. 8. As shown in FIG. 8, the first housing 030 tends to have a relatively low temperature on the side of the bearing housing 006, and bending deformation in the direction of arrow A shown in FIGS. 7 and 8 occurs in the first housing 030 due to the temperature distribution.

Thus, in the turbocharger shown in FIGS. 7 to 9, there is a risk of the shroud, which is a part of the first housing, making contact with the turbine wheel near the position P1 on the side of a tongue portion (in a double-layer structure, the portion at the end of the roll of the scroll flow path in the first housing) of the turbine housing due to the bending deformation, unless an adequate tip clearance is provided between the shroud and the turbine wheel.

Thus, to avoid such contact, it is necessary to provide a wide tip clearance between the turbine wheel and the shroud so that such contact does not occur even in the event of bending deformation. However, this clearance generates a loss that impairs improvement of the turbine efficiency.

In this regard, a part of an object of the turbocharger described in Patent Document 1 is to prevent a change in the tip clearance due to thermal deformation of the scroll part body, but the scroll part body is directly connected to the shroud, which limits the effect to reduce an influence of thermal deformation of the scroll part body on the change of the tip clearance. Thus, it is difficult to achieve a high turbine efficiency while avoiding contact between the turbine wheel and the shroud.

The present invention was made in view of the above, and an object of the present invention is to provide a turbocharger capable of achieving a high turbine efficiency while avoiding contact between a turbine wheel and a shroud.

Solution to the Problems (1) A turbocharger according to at least one embodiment of the present invention comprises: a turbine wheel configured to be rotated by exhaust gas of an engine; a turbine housing which accommodates the turbine wheel and forms at least a part of a scroll flow path through which exhaust gas to be supplied to the turbine wheel flows; a bearing housing which accommodates a bearing supporting a shaft of the turbine wheel rotatably, the bearing housing being coupled to the turbine housing; a shroud having a facing surface which faces a tip of a blade of the turbine wheel and being configured to surround the turbine wheel, the shroud being disposed inside the turbine housing via a gap with respect to the turbine housing; a mount supported to at least one of the turbine housing or the bearing housing, at a position closer to the bearing housing than the scroll flow path in an axial direction of the turbine wheel; and at least one connection part connecting the mount and the shroud.

With the above turbocharger (1), even if a temperature variation is generated in the turbine housing by the exhaust gas flowing through the scroll flow path to cause bending deformation (thermal deformation) of the turbine housing, the shroud is formed by a member separate from the turbine housing with a gap provided between the shroud and the turbine housing, and thus the tip clearance between the shroud and the turbine wheel is not basically affected by the above bending deformation of the turbine housing. Thus, even if the tip clearance is small between the shroud and the turbine wheel, it is possible to avoid contact between the shroud and the turbine wheel due to the above bending deformation of the turbine housing. Thus, it is possible to achieve a high turbine efficiency while avoiding contact between the turbine wheel and the shroud.

(2) In some embodiments, in the above turbocharger (1), each of the connection part has a blade shape in a cross section perpendicular to an axis of the turbine wheel.

According to the above turbocharger (2), in the above turbocharger (1), the connection part having a blade-shape cross section in a direction perpendicular to the axis of the turbine wheel rectifies the flow of exhaust gas flowing between the shroud and the mount, and thereby it is possible to achieve an even higher turbine efficiency.

(3) In some embodiments, the turbocharger according to the above (1) or (2) further comprises a seal ring which seals the gap between the shroud and the turbine housing.

According to the above turbocharger (3), in the turbocharger described in the above (1) or (2), leakage of exhaust gas from the gap between the shroud and the turbine housing can be suppressed with the above seal ring. Thus, it is possible to suppress a decrease in the turbine efficiency due to leakage of exhaust gas from the gap, and to achieve an even higher turbine efficiency.

(4) In some embodiments, in the turbocharger according to any one of the above (1) to (3), the mount is held between the turbine housing and the bearing housing.

With the above turbocharger (4), the mount is held by the turbine housing and the bearing housing that a turbocharger is originally equipped with, and thereby the turbocharger described in the above (1) to (3) can be realized with a simple configuration.

(5) In some embodiments, in the above turbocharger (4), the mount is an annular plate, and an outer peripheral portion of the mount is held between the turbine housing and the bearing housing.

With the above turbocharger (5), by setting the thickness of the annular plate appropriately, it is possible to form a part of the scroll flow path by utilizing a side surface of the annular plate while ensuring the rigidity of the mount for supporting the connection part and the shroud. Furthermore, even in a case where the side surface of the annular plate is utilized to form a part of the scroll flow path, if the thickness direction of the annular plate and the axial direction of the turbine wheel are the same, it is possible to reduce the thermal expansion amount of the mount in the axial direction of the turbine wheel, and thus it is possible to suppress fluctuation of the tip clearance between the turbine wheel and the shroud.

(6) In some embodiments, the above turbocharger (5) further comprises a bolt fastening the turbine housing and the bearing housing. An outer peripheral portion of the mount is held between the turbine housing and the bearing housing by an axial force of the bolt.

With the above turbocharger (6), the mount is mounted to the turbine housing and the bearing housing by fastening the turbine housing and the bearing housing with the bolt, and thereby it is possible to fix the mount to the turbine housing and the bearing housing with a simple configuration by setting the fastening force of the bolt appropriately.

(7) In some embodiments, in the above turbocharger (4), the mount includes a tube-shaped portion extending in the axial direction of the turbine wheel and a protruding portion protruding toward an outer peripheral side of the tube-shaped portion from the tube-shaped portion. Furthermore, the protruding portion of the mount is held between the turbine housing and the bearing housing.

With the above turbocharger (7), the mount can be held between the turbine housing and the bearing housing at a position corresponding to the axial directional length of the tube-shaped portion.

(8) In some embodiments, the above turbocharger (7) further comprises a nipping member which nips and couples a flange disposed on the turbine housing and a flange disposed on the bearing housing. The protruding portion of the mount is nipped between the turbine housing and the bearing housing by a nipping force of the nipping member.

With the above turbocharger (8), the mount is mounted to the turbine housing and the bearing housing by nipping the turbine housing and the bearing housing with the nipping member, and thereby it is possible to fix the mount to the turbine housing and the bearing housing with a simple configuration by setting the nipping force of the nipping member appropriately.

(9) In some embodiments, in the turbocharger according to any one of the above (1) to (8), the mount is an annular member and includes an engagement portion engaged with an annular step portion formed on the bearing housing by spigot-and-socket fitting.

With the above turbocharger (9), it is possible to make the axial center of the shroud supported on the mount via the connection part and the axial center of the shaft supported on the bearing coincide with each other with a simple configuration.

(10) In some embodiments, in the turbocharger according to any one of the above (1) to (9), the turbine housing includes a first housing formed of sheet metal, the first housing accommodating the turbine wheel and forming at least a part of the scroll flow path, and the shroud is disposed inside the first housing via the gap with respect to the first housing.

In a case where the turbine housing includes the first housing made of sheet metal accommodating the turbine wheel and forming at least a part of the scroll flow path, as compared to a case in which the turbine housing including the first housing is entirely formed of cast, considerable bending deformation (thermal deformation) is likely to occur in the first housing due to exhaust gas flowing through the scroll flow path. In this case, if the shroud is disposed inside the first housing formed of sheet metal via a gap from the first housing as described in the above (10), the shroud is basically not affected by an influence of such bending deformation. Thus, even if the tip clearance is small between the shroud and the turbine wheel, it is possible to avoid contact between the shroud and the turbine wheel due to the above bending deformation of the first housing made of sheet metal. Thus, it is possible to achieve a high turbine efficiency while avoiding contact between the turbine wheel and the shroud.

(11) In some embodiments, in the above turbocharger (10), the turbine housing has a double-layer structure including a second housing formed of sheet metal and accommodating the first housing.

With the above turbocharger (11), the turbine housing is a double-layer structure housing, and thus it is possible to prevent fragments of the turbine wheel from scattering outside the turbine housing reliably as compared to a case of a single-layer structure, in case the turbine housing breaks for some reason and the fragments scatter.

(12) In some embodiments, the above turbocharger (11) further comprises: an outlet guide tube configured integrally with the second housing so as to guide exhaust gas having passed through the turbine wheel; and a piston ring sealing a gap between the first housing and the outlet guide tube so that the first housing is slidable with respect to the outlet guide tube in the axial direction of the turbine wheel.

In a case where the turbine housing is a double-layer structure housing including the first housing and the second housing as described in the above (11), the first housing forming at least a part of the scroll flow path has a relatively high temperature and a great thermal expansion amount, compared to the second housing. Thus, unless some measure is provided, stress may concentrate on the connection part between the first housing and the second housing and cause breakage. Thus, the above turbocharger (12) further includes a piston ring for sealing the gap between the first housing and the outlet guide tube, so that the first housing is slidable in the axial direction with respect to the outlet guide tube formed integrally with the second housing. Accordingly, it is possible to avoid breakage due to a difference in the thermal expansion amount of the first housing and the second housing, while suppressing leakage of exhaust gas from the gap between the first housing and the outlet guide tube.

(13) In some embodiments, in the above turbocharger (10), the turbine housing has a single-layer structure, and a thickness of the shroud is greater than a thickness of the first housing.

Even if the turbine housing is a single-structure housing as described in the above (13), the thickness of the shroud is greater than the thickness of the first housing, and thereby it is possible to receive fragments of the turbine wheel effectively with less material in case of breakage of the turbine wheel, compared to a case in which the thickness of the first housing is greater than the thickness of the shroud.

(14) In some embodiments, in the above turbocharger (13), the thickness of the shroud is not less than twice the thickness of the first housing.

With the above turbocharger (14), it is possible to receive fragments of the turbine wheel effectively with less material in case of breakage of the turbine wheel, compared to a case in which the thickness of the first housing is greater than the thickness of the shroud.

Advantageous Effects

According to at least one embodiment of the present invention, provided is a turbocharger capable of achieving a high turbine efficiency while avoiding contact between a turbine wheel and a shroud.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
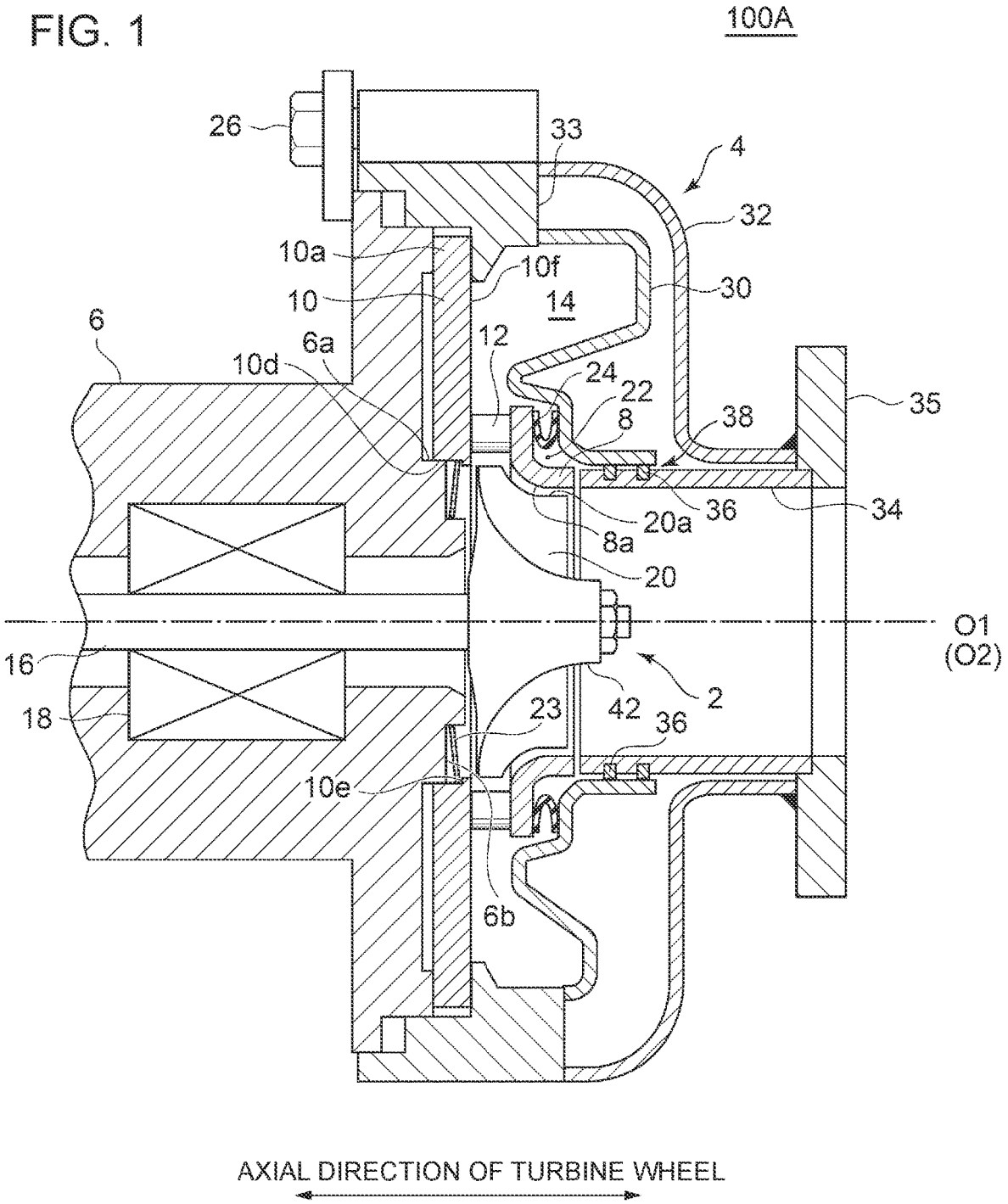
FIG. 1 is a schematic configuration diagram of a cross section of a turbocharger 100A according to an embodiment.
Figure 2:
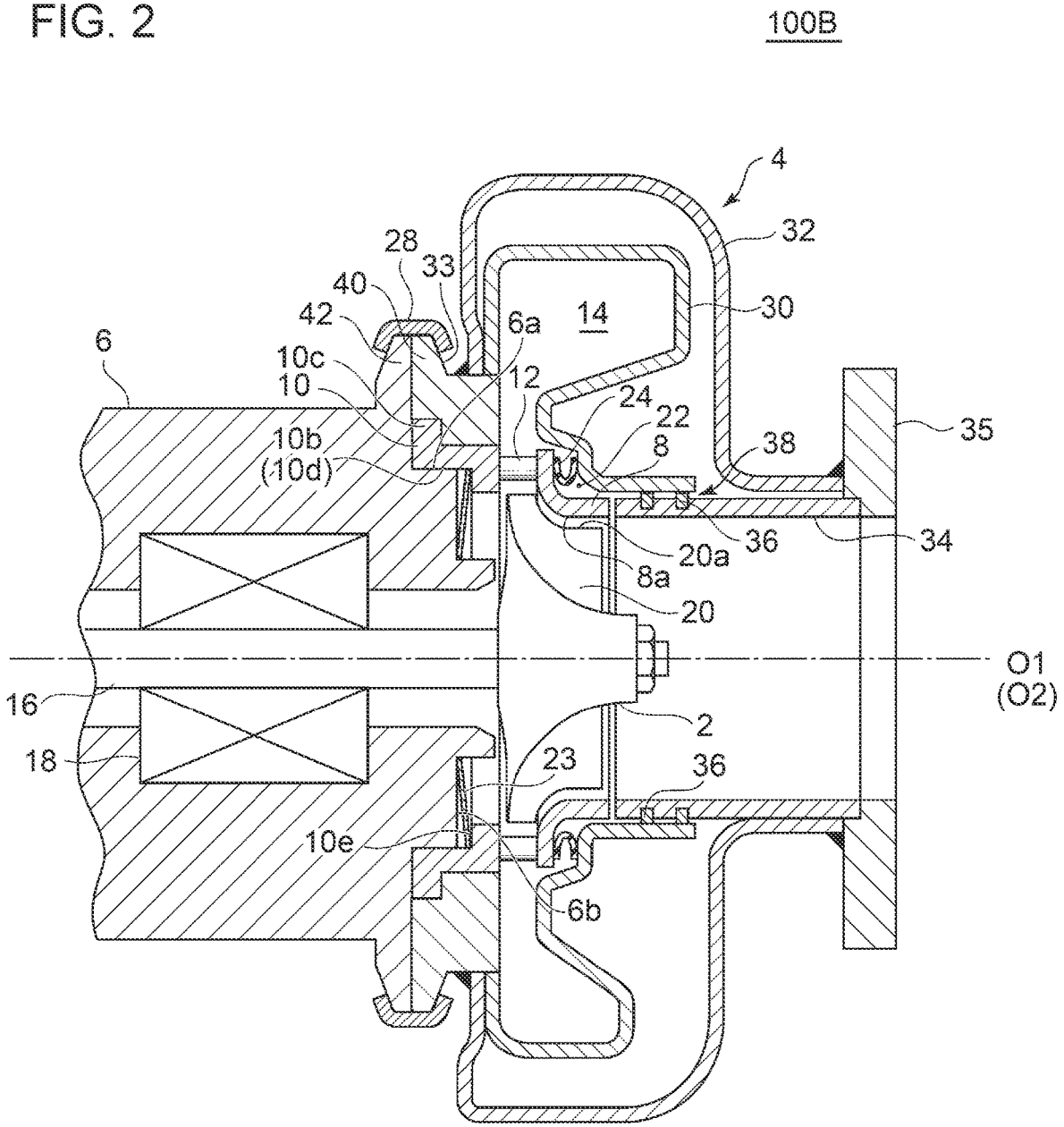
FIG. 2 is a schematic configuration diagram of a cross section of a turbocharger 100B according to an embodiment.
Figure 3:
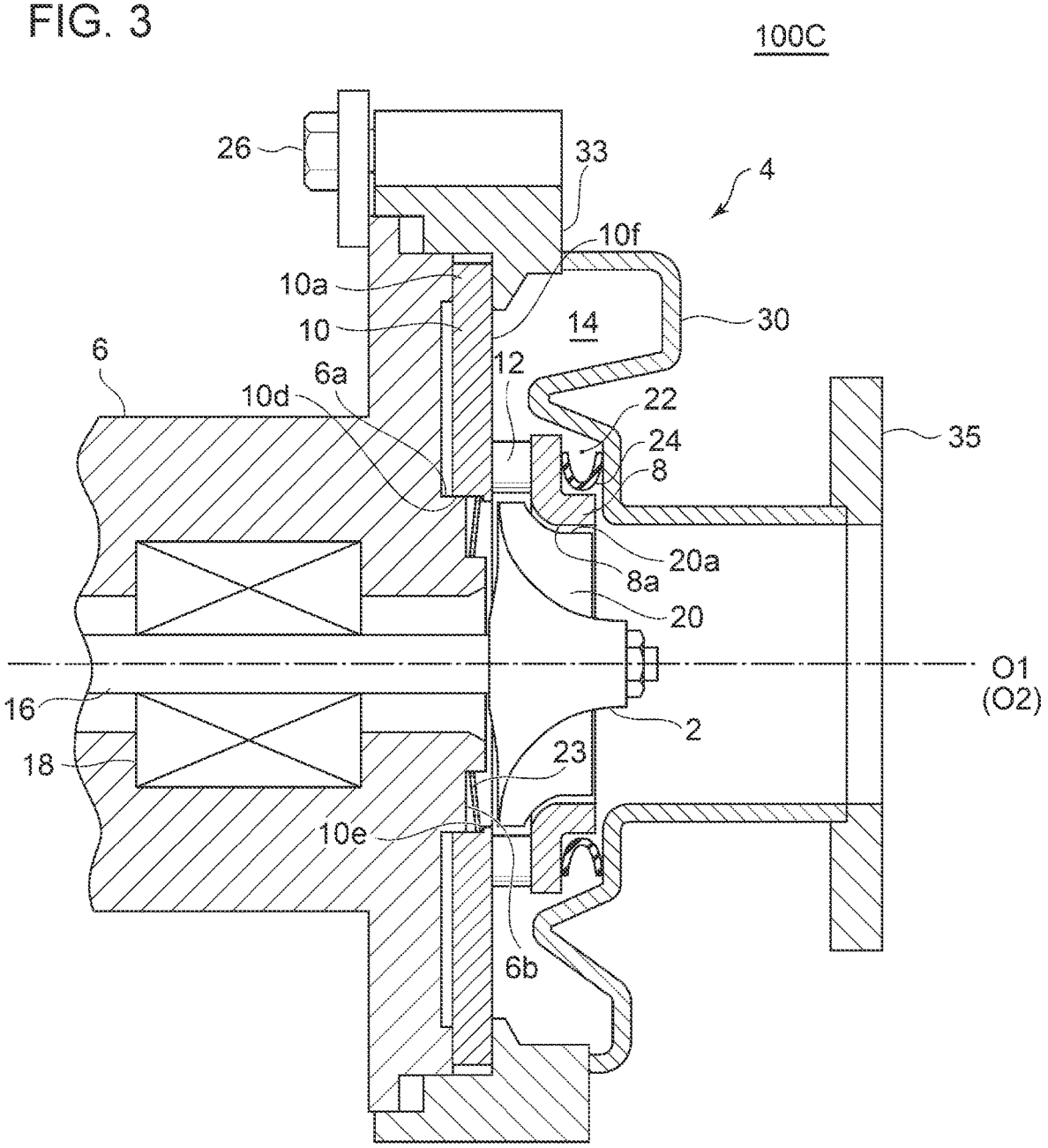
FIG. 3 is a schematic configuration diagram of a cross section of a turbocharger 100C according to an embodiment.
Figure 4:
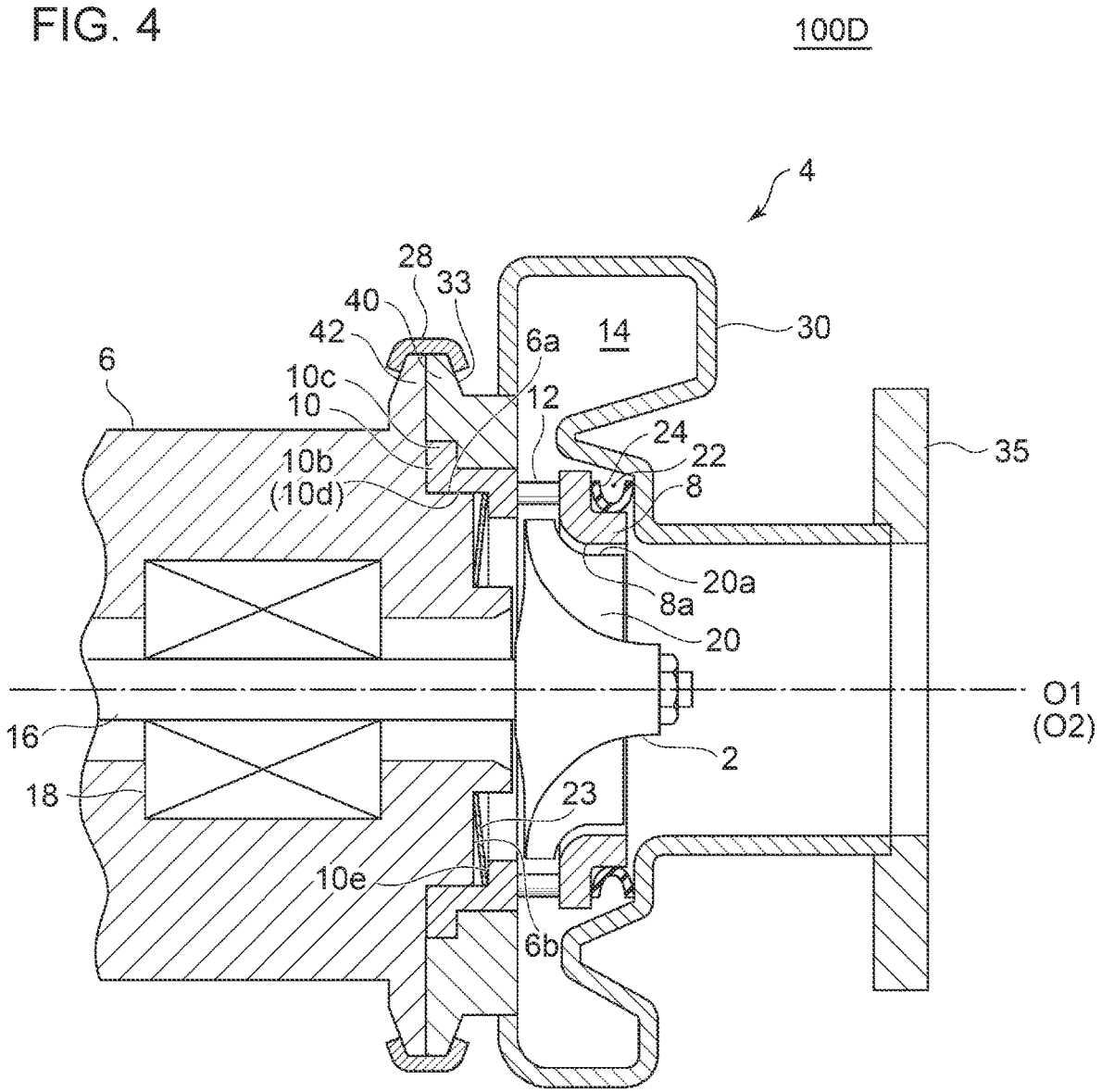
FIG. 4 is a schematic configuration diagram of a cross section of a turbocharger 100D according to an embodiment.

FIG. 1 is a schematic configuration diagram of a cross section of a turbocharger 100A according to an embodiment. FIG. 2 is a schematic configuration diagram of a cross section of a turbocharger 100B according to an embodiment. FIG. 3 is a schematic configuration diagram of a cross section of a turbocharger 100C according to an embodiment. FIG. 4 is a schematic configuration diagram of a cross section of a turbocharger 100D according to an embodiment.

In some embodiments, as shown in FIGS. 1 to 4 for example, the turbocharger 100 (100A to 100D) includes a turbine wheel 2, a turbine housing 4, a bearing housing 6, a shroud 8, a mount 10, and at least one connection part 12.

In the turbocharger 100 (100A to 100D) shown in FIGS. 1 to 4, the turbine wheel 2 is configured to be rotated by exhaust gas of an engine (not shown). The turbine housing 4 houses the turbine wheel 2, and forms at least a part of a scroll flow path 14 through which exhaust gas to be supplied to the turbine wheel 2 flows. The bearing housing 6 accommodates a bearing 18 that supports a shaft 16 of the turbine wheel 2 rotatably, and is coupled to the turbine housing 4. The shroud 8 has a facing surface 8*a* facing an end 20*a* of a blade 20 of the turbine wheel 2, and is configured to surround the turbine wheel 2. Further, the shroud 8 is formed by a member separate from the turbine housing 4, and is disposed inside the turbine housing 4 via a gap 22 with respect to the turbine housing 4. The mount 10 is supported on at least one of the turbine housing 4 or the bearing housing 6, at a position closer to the bearing housing 6 than the scroll flow path 14 in the axial direction of the turbine wheel 2. Each of the at least one connection part 12 (a plurality of connection parts 12 in the embodiment shown in FIGS. 1 to 4) is configured to connect the mount 10 and the shroud 8.

As described above with the turbocharger 100 (100A to 100D), even if a temperature variation is generated in the turbine housing 4 by the exhaust gas flowing through the scroll flow path 14 to cause bending deformation (thermal deformation) of the turbine housing 4, the shroud 8 is formed by a member separate from the turbine housing 4 and is disposed via the gap 22 with respect to the turbine housing 4, and thus the tip clearance (clearance between the facing surface 8*a* and the tip 20*a*) between the shroud 8 and the turbine wheel 2 is not basically affected by the above bending deformation of the turbine housing 4. Thus, even if the tip clearance is small between the shroud 8 and the turbine wheel 2, it is possible to avoid contact between the shroud 8 and the turbine wheel 2 due to the above bending deformation of the turbine housing 4. Thus, it is possible to achieve a high turbine efficiency while avoiding contact between the turbine wheel 2 and the shroud 8.

In some embodiments, as shown in FIGS. 1 to 4, the turbine housing 4 includes the first housing 30 made of sheet metal, accommodating the turbine wheel 2 and forming at least a part of the scroll flow path 14, and the shroud 8 is disposed inside the first housing 30, via the gap 22 with respect to the first housing 30.

In such configuration, as compared to a case in which the turbine housing 4 including the first housing 30 is entirely formed of cast, the first housing 30 is formed of sheet metal and thus considerable bending deformation (thermal deformation) is likely to occur in the first housing 30 due to exhaust gas flowing through the scroll flow path 14. Also in this case, the shroud 8 is disposed inside the first housing 30 formed of sheet metal via the gap 22 with respect to the first housing 30, and thus it is possible to achieve a high turbine efficiency while avoiding contact between the turbine wheel 2 and the shroud 8, as described above.

In some embodiments, as shown in FIGS. 1 and 2 for instance, the turbine housing 4 is a double-layer structure housing further including the second housing 32 formed of sheet metal and accommodating the first housing 30.

In the above configuration, the turbine housing is a double-layer structure housing, and thus it is possible to prevent fragments of the turbine wheel 2 from scattering outside the turbine housing 4 reliably as compared to a case of a single-layer structure, in case the turbine wheel 2 breaks in fragments and scatters for some reason.

In some embodiments, as shown in FIGS. 1 and 2 for instance, the turbocharger 100 (100A, 100B) further includes an outlet guide tube 34 and a piston ring 36. The outlet guide tube 34 is configured to guide exhaust gas having passed through the turbine wheel 2, and is joined to the outlet flange 35 of the turbine housing 4. The outlet flange 35 is joined to the second housing 32 by welding, for instance, and the second housing 32 and the outlet guide tube 34 are formed integrally with the outlet flange 35. The piston ring 36 is configured to seal the gap 38 between the first housing 30 and the outlet guide tube 34 so that the first housing 30 is slidable with respect to the outlet guide tube 34 in the axial direction of the turbine wheel 2.

In a case where the turbine housing 4 is a double-layer structure housing including the first housing 30 and the second housing 32 as shown in FIGS. 1 and 2, the first housing 30 forming at least a part of the scroll flow path 14 has a relatively high temperature and a great thermal expansion amount, compared to the second housing 32. Thus, unless some measure is provided, stress may concentrate on the connection part between the first housing 30 and the second housing 32 to cause breakage. In this regard, as described above, the turbocharger 100 (100A, 100B) shown in FIGS. 1 and 2 is provided with the piston ring 36 for sealing the gap 38 between the first housing 30 and the outlet guide tube 34, so that the first housing 30 is slidable in the axial direction with respect to the outlet guide tube 34 formed integrally with the second housing 32. Accordingly, it is possible to avoid breakage due to a difference in the thermal expansion amount of the first housing 30 and the second housing 32, while suppressing a leakage of exhaust gas from the gap 38 between the first housing 30 and the outlet guide tube 34.

In some embodiments, as shown in FIGS. 3 and 4 for instance, the turbine housing 4 is a single-layer structure housing, and the thickness of the shroud 8 is greater than the thickness of the first housing 30.

Even if the turbine housing 4 is a single-structure housing as described above, the thickness of the shroud 8 is greater than the thickness of the first housing 30, and thereby it is possible to receive fragments of the turbine wheel 2 effectively with less material in case of breakage of the turbine wheel 2, compared to a case in which the thickness of the first housing 30 is greater than the thickness of the shroud 8. The thickness of the shroud 8 is desirably not less than twice the thickness of the first housing 30.

In some embodiments, as shown in FIGS. 1 to 4 for instance, the turbine housing 4 has an annular structural part 33 disposed on a portion of the turbine housing 4 adjacent to the bearing housing 6, and the mount 10 is held between the structural part 33 of the turbine housing 4 and the bearing housing 6. In the turbine housing 4 having a double-layer structure shown in FIGS. 1 and 2, the annular structural part 33 is a cast, for instance, and may be joined by welding or the like to the first housing 30 formed of sheet metal and the second housing 32 formed of sheet metal. Furthermore, in the turbine housing 4 having a single-layer structure shown in FIGS. 3 and 4, the annular structural part 33 is a cast, for instance, and may be joined by welding or the like to the first housing 30.

As described above, in the turbocharger 100 (100A to 100D) shown in FIGS. 1 to 4, the mount 10 is held by the turbine housing 4 and the bearing housing 6 that a turbocharger is originally equipped with, and thereby the mount 10 can be fixed with a simple configuration.

In some embodiments, in the turbocharger 100 (100A, 100C) shown in FIGS. 1 and 3 for instance, the mount 10 is an annular plate, and an outer peripheral portion 10*a* of the mount 10 is held between the turbine housing 4 and the bearing housing 6.

In this case, the thickness of the annular plate is set appropriately, and thereby it is possible to form a part of the scroll flow path 14 by utilizing a side surface 10*f* of the mount 10 while ensuring the rigidity of the mount 10 for supporting the shroud 8 via the connection part 12. Furthermore, even in a case where the side surface 10*f* of the mount 10 is utilized to form a part of the scroll flow path 14, if the thickness direction of the mount 10 and the axial direction of the turbine wheel 2 are the same, it is possible to reduce the thermal expansion amount of the mount 10 in the axial direction of the turbine wheel 2, and thus it is possible to suppress fluctuation of the tip clearance between the turbine wheel 2 and the shroud 8.

In some embodiments, as shown in FIGS. 1 and 3 for instance, the turbocharger 100 (100A, 100C) further includes a bolt 26 fastening the structural part 33 of the turbine housing 4 and the bearing housing 6. In this case, the outer peripheral portion 10*a* of the mount 10 is held between the structural part 33 of the turbine housing 4 and the bearing housing 6 by an axial force of the bolt 26.

As described above, the mount 10 is mounted to the turbine housing 4 and the bearing housing 6 by fastening the turbine housing 4 and the bearing housing 6 with the bolt 26, and thereby it is possible to fix the mount 10 to the turbine housing 4 and the bearing housing 6 with a simple configuration by setting the fastening force of the bolt 26 appropriately.

In some embodiments, as shown in FIGS. 2 and 4 for instance, the mount 10 includes a tube-shaped portion 10*b* extending in the axial direction of the turbine wheel 2, and a protruding portion 10*c* having an annular shape and protruding toward the outer peripheral side of the tube-shaped portion 10*b* from the tube-shaped portion 10*b*. In this case, the protruding portion 10*c* of the mount 10 is held between the turbine housing 4 and the bearing housing 6. Accordingly, the mount 10 can be held between the turbine housing 4 and the bearing housing 6 at a position corresponding to the axial directional length of the tube-shaped portion 10*b*.

In some embodiments, as shown in FIGS. 2 and 4 for instance, the turbocharger 100 (100B, 100D) further includes a nipping member 28 nipping and coupling a flange 40 disposed on the structural part 33 of the turbine housing 4 and a flange 42 disposed on the bearing housing 6. In this case, the protruding portion 10*c* of the mount 10 is held between the structural part 33 of the turbine housing 4 and the bearing housing 6 by the nipping force of the nipping member 28. Furthermore, the nipping member 28 may be a C ring having a C-shape cross section.

As described above, the mount 10 is mounted to the turbine housing 4 and the bearing housing 6 by fastening the flange of the turbine housing 4 and the flange of the bearing housing 6 with the nipping member 28, and thereby it is possible to fix the mount 10 to the turbine housing 4 and the bearing housing 6 with a simple configuration by setting the nipping force of the bolt 28 appropriately.

In some embodiments, as shown in FIGS. 1 to 4, the mount 10 is an annular member, and has an engagement portion 10*d* engaged with an annular step portion 6*a* formed on the bearing housing 6, by socket-and-spigot fitting. Accordingly, it is possible to make the axial center O2 of the shroud 8 supported on the mount 10 via the connection part 12 and the axial center O1 of the shaft 16 supported on the bearing 18 coincide with each other with a simple configuration.

In some embodiments, as shown in FIGS. 1 to 4 for instance, the turbocharger 100 (100A to 100D) further includes a back plate 23. The back plate 23 is provided to seal exhaust gas leaking from the inlet of the turbine wheel 5 and flowing toward the back surface of the turbine wheel 5, and insulate the bearing side from heat. The outer peripheral end of the back plate 23 is supported by an annular step portion 10*e* disposed on the inner peripheral surface of the mount 10, and the inner peripheral end of the back plate is supported by the annular step portion 6*b* of the bearing housing 6. Furthermore, the annular step portion 6*b* is disposed on the inner peripheral side of the annular step portion 6*a*.

In some embodiments, as shown in FIGS. 1 and 4 for instance, the turbocharger 100 (100A to 100D) further includes a seal ring 24 that seals the gap 22 between the shroud 8 and the first housing 30. It is desirable for the seal ring 24 to have such an elasticity that can maintain the seal of the gap between the shroud 8 and the first housing 30 even in case of thermal deformation of the first housing 30, and for instance, the seal ring 24 may have a C-shaped cross section as shown in FIGS. 1 to 4, may be an O-ring, or may have another shape.

Accordingly, it is possible to suppress leakage of exhaust gas from the gap 22 between the shroud 8 and the first housing 30 with the seal ring 24. Thus, it is possible to suppress a decrease in the turbine efficiency due to leakage of exhaust gas from the gap 22, and to achieve an even higher turbine efficiency.

Figure 5:
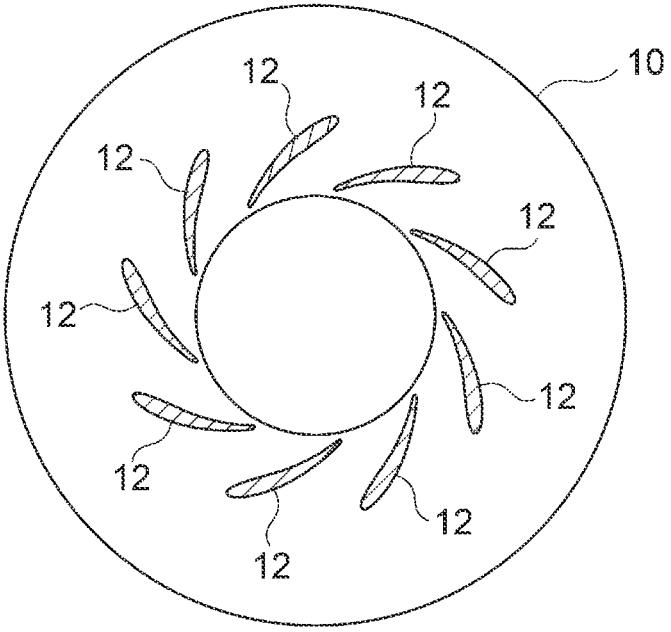
FIG. 5 is a diagram showing an example of a cross-sectional shape perpendicular to the axis O1 of the turbine wheel 2 in the connection part 12 shown in FIGS. 1 to 4.
Figure 6:
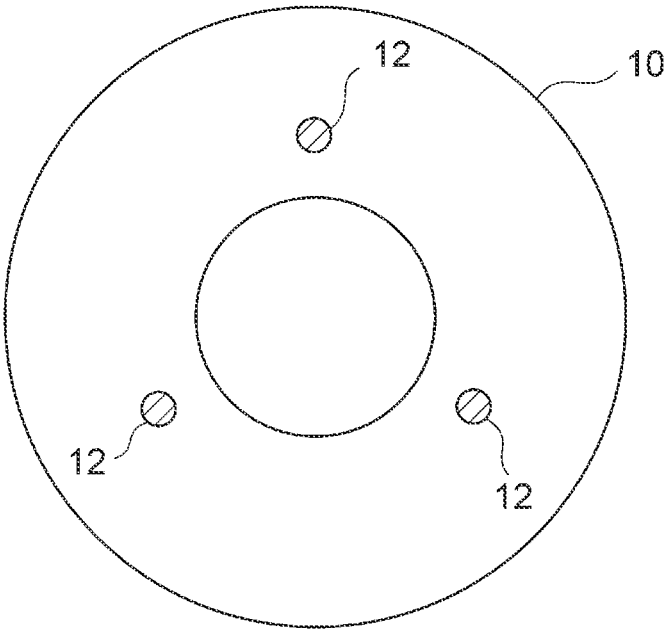
FIG. 6 is a diagram showing an example of a cross-sectional shape perpendicular to the axis O1 of the turbine wheel 2 in the connection part 12 shown in FIGS. 1 to 4.
Figure 7:
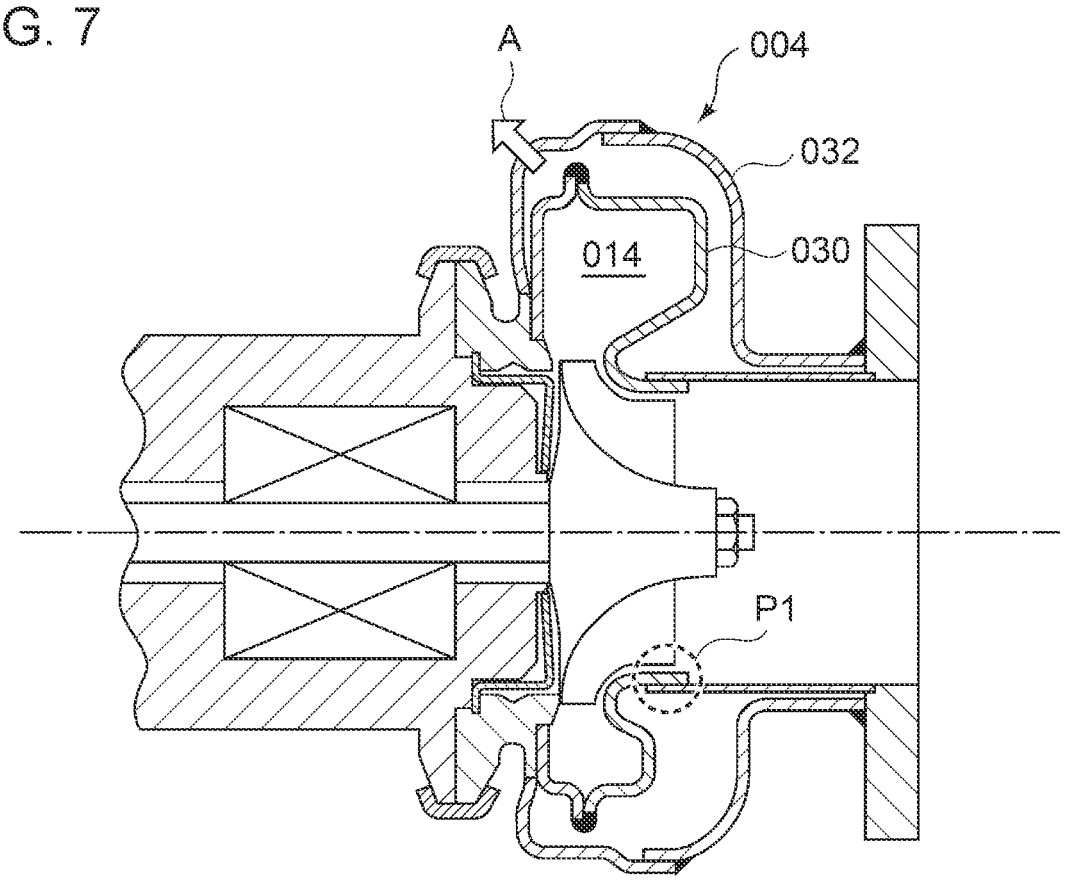
FIG. 7 is a schematic configuration diagram of a cross section of a turbocharger according to a reference example.
Figure 8:
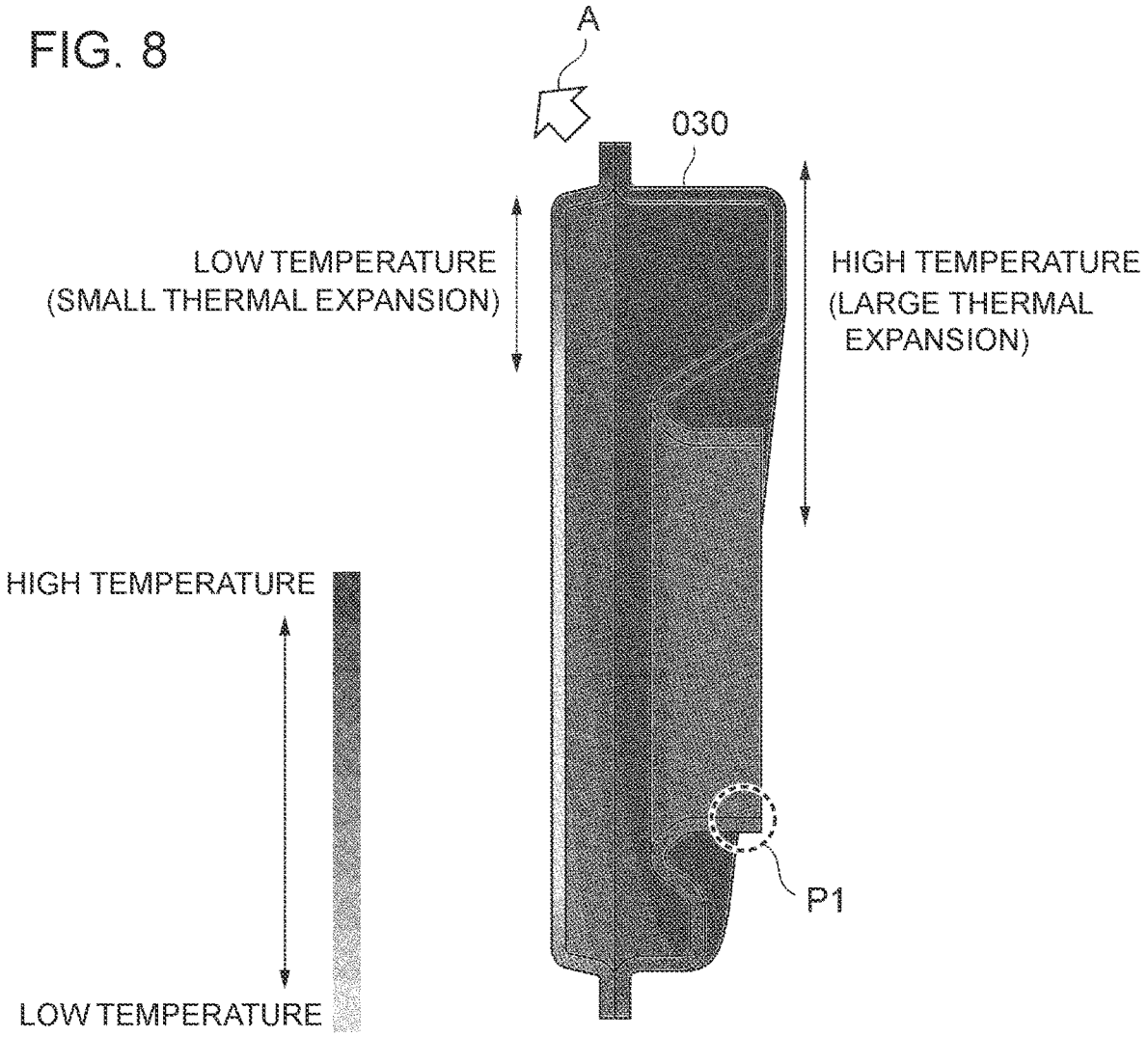
FIG. 8 is a diagram showing a temperature distribution of the inner casing 030 during operation of the turbocharger shown in FIG. 7.
Figure 9:
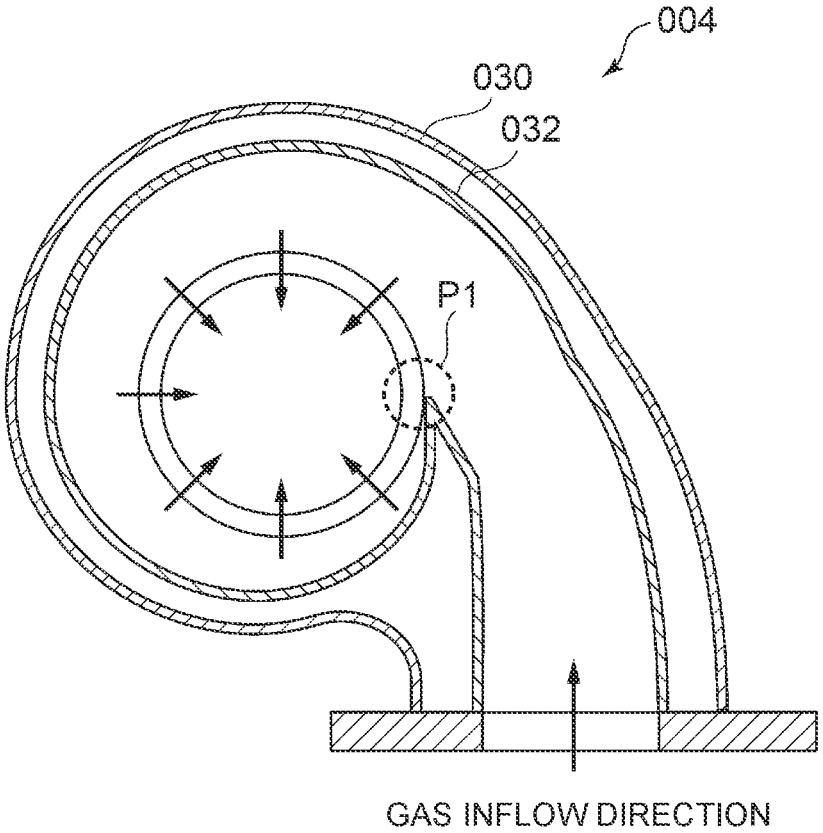
FIG. 9 is a schematic diagram of a cross-sectional configuration perpendicular to the axis of the turbine housing 004 shown in FIG. 7.

FIG. 5 is a diagram showing an example of a cross-sectional shape perpendicular to the axis O1 of the turbine wheel 2 in the connection part 12 shown in FIGS. 1 to 4. FIG. 6 is a diagram showing another example of a cross-sectional shape perpendicular to the axis O1 of the turbine wheel 2 in the connection part 12 shown in FIGS. 1 to 4.

In some embodiments, as shown in FIG. 5, each of the connection parts 12 has a blade-shape cross section perpendicular to the axis of the turbine wheel 2. In the depicted embodiment, the leading edge portion of the blade shape (upstream side of exhaust gas flow) is positioned outside, in the radial direction, of the trailing edge portion (downstream side of exhaust gas flow), along the flow direction of exhaust gas flowing through the scroll flow path 14 into the turbine wheel 2. Accordingly, the connection part 12 having a blade-shape cross section in a direction perpendicular to the axis O1 of the turbine wheel 2 rectifies the flow of exhaust gas flowing between the shroud 8 and the mount 10, and thereby it is possible to achieve an even higher turbine efficiency.

In some embodiments, as shown in FIG. 6, each of the connection parts 12 has a circular cross section in a direction perpendicular to the axis of the turbine wheel 2. Accordingly, it is possible to connect the shroud 8 and the mount 10 with a simple configuration.

Embodiments of the present invention were described in detail above, but the present invention is not limited thereto, and various amendments and modifications may be implemented.

DESCRIPTION OF REFERENCE NUMERALS

2 Turbine wheel
4 Turbine housing
6 Bearing housing
6*a* Step portion
6*b* Step portion
8 Shroud
8*a* Facing surface
10 Mount
10*a* Outer peripheral portion
10*b* Tube-shaped portion
10*c* Protruding portion
10*d* Engagement portion
10*e* Step portion
10*f* Side surface
12 Connection part
14 Scroll flow path
16 Shaft
18 Bearing
20 Blade
20*a* Tip
22 Gap
23 Back plate
24 Seal ring
26 Bolt
28 Nipping member
30 First housing
32 Second housing
33 Structural part
34 Outlet guide tube
35 Outlet flange
36 Piston ring
38 Gap
40 Flange
42 Flange
100 (100A, 100B, 100C, 100D) Turbocharger

The invention claimed is:

1. A turbocharger, comprising:

a turbine wheel configured to be rotated by exhaust gas of an engine;

a turbine housing which accommodates the turbine wheel and forms at least a part of a scroll flow path through which exhaust gas to be supplied to the turbine wheel flows;

a bearing housing which accommodates a bearing supporting a shaft of the turbine wheel rotatably, the bearing housing being coupled to the turbine housing;

a shroud having a facing surface which faces a tip of a blade of the turbine wheel and being configured to surround the turbine wheel, the shroud comprising a separate member from the turbine housing and being disposed inside the turbine housing via a gap with respect to the turbine housing;

a mount supported to at least one of the turbine housing or the bearing housing, at a position closer to the bearing housing than the scroll flow path in an axial direction of the turbine wheel; and at least one connection part connecting the mount and the shroud, wherein the turbine housing includes a first housing formed of sheet metal, the first housing accommodating the turbine wheel and forming at least a part of the scroll flow path, and wherein the shroud is disposed inside the first housing via the gap with respect to the first housing, and wherein the turbocharger further comprises:

an outlet guide tube configured to guide exhaust gas having passed through the turbine wheel, the outlet guide tube being disposed on a downstream side in the axial direction of the turbine wheel with respect to the shroud;

the facing surface comprises a first wall which extends in a radial direction from the axial direction of the turbine wheel and a second wall which extends in the axial direction of the turbine wheel, wherein the second wall is spaced apart from the outlet guide tube, and a piston ring which seals a gap between the first housing and the outlet guide tube, the piston ring being sliding the first housing on to the outlet guide tube in the axial direction of the turbine wheel.

2. The turbocharger according to claim 1, wherein each of the at least one connection part has a blade shape in a cross section perpendicular to an axis of the turbine wheel.

3. The turbocharger according to claim 1, further comprising a seal ring which seals the gap between the shroud and the turbine housing.

4. The turbocharger according to claim 1, wherein the mount is held between the turbine housing and the bearing housing.

5. The turbocharger according to claim 4, wherein the mount is an annular plate, and wherein an outer peripheral portion of the mount is held between the turbine housing and the bearing housing.

6. The turbocharger according to claim 5, further comprising a bolt fastening the turbine housing and the bearing housing, wherein the outer peripheral portion of the mount is held between the turbine housing and the bearing housing by an axial force of the bolt.

7. The turbocharger according to claim 4, wherein the mount includes a tube-shaped portion extending in the axial direction of the turbine wheel and a protruding portion protruding toward an outer peripheral side of the tube- shaped portion from the tube-shaped portion, and wherein the protruding portion of the mount is held between the turbine housing and the bearing housing.

8. The turbocharger according to claim 7, further comprising a nipping member which nips and couples a flange disposed on the turbine housing and a flange disposed on the bearing housing, wherein the protruding portion of the mount is nipped between the turbine housing and the bearing housing by a nipping force of the nipping member.

9. The turbocharger according to claim 1, wherein the mount is an annular member and includes an engagement portion engaged with an annular step portion formed on the bearing housing by spigot-and-socket fitting.

10. The turbocharger according to claim 9, wherein the turbine housing has a double-layer structure including a second housing formed of sheet metal, the second housing accommodating the first housing.

11. The turbocharger according to claim 10, wherein the outlet guide tube is configured integrally with the second housing by an outlet flange joined to the second housing.

12. The turbocharger according to claim 9, wherein the turbine housing has a single-layer structure, and a thickness of the shroud is greater than a thickness of the first housing.

13. The turbocharger according to claim 12, wherein the thickness of the shroud is not less than twice the thickness of the first housing.

* * * * *